US010016059B2

(12) United States Patent
Leonard et al.

(10) Patent No.: US 10,016,059 B2
(45) Date of Patent: Jul. 10, 2018

(54) FLEXIBLE SUBSTRATE ASSEMBLY AND ASSOCIATED FURNITURE USING THE SAME

(71) Applicants: James R. Leonard, Holland, MI (US); William D. Blair, Holland, MI (US)

(72) Inventors: James R. Leonard, Holland, MI (US); William D. Blair, Holland, MI (US)

( * ) Notice: Subject to any disclaimer, the term of this patent is extended or adjusted under 35 U.S.C. 154(b) by 0 days.

(21) Appl. No.: 14/707,776

(22) Filed: May 8, 2015

(65) Prior Publication Data

US 2016/0022044 A1 Jan. 28, 2016

Related U.S. Application Data

(60) Provisional application No. 61/990,133, filed on May 8, 2014.

(51) Int. Cl.

| | |
|---|---|
| ***A47C 7/14*** | (2006.01) |
| ***A47C 1/121*** | (2006.01) |
| ***A47C 4/02*** | (2006.01) |
| ***A47C 5/12*** | (2006.01) |
| ***A47C 7/00*** | (2006.01) |
| ***A47C 7/28*** | (2006.01) |
| ***A47C 1/02*** | (2006.01) |
| ***A47C 7/56*** | (2006.01) |

(52) U.S. Cl.

CPC ..... *A47C 7/14* (2013.01); *A47C 1/02* (2013.01); *A47C 1/121* (2013.01); *A47C 4/02* (2013.01); *A47C 5/12* (2013.01); *A47C 7/004* (2013.01); *A47C 7/28* (2013.01); *A47C 7/285* (2013.01); *A47C 7/566* (2013.01)

(58) Field of Classification Search

CPC .. A47C 7/14; A47C 1/121; A47C 4/02; A47C 5/12; A47C 7/004; A47C 7/28; A47C 7/285; A47C 1/02; A47C 7/566

USPC ..... 297/452.56, 452.63

See application file for complete search history.

(56) References Cited

U.S. PATENT DOCUMENTS

| | | | |
|---|---|---|---|
| 2,257,496 | A | 9/1941 | Gaugler et al. |
| 2,492,119 | A | 12/1949 | Roman |
| 2,828,803 | A | 4/1958 | Howe et al. |
| 3,297,359 | A | 1/1967 | Douglas |

(Continued)

FOREIGN PATENT DOCUMENTS

| | | |
|---|---|---|
| JP | 2012/236541 | 12/2012 |
| WO | WO 2011/143467 | 11/2011 |

*Primary Examiner* — Rodney B White

(74) *Attorney, Agent, or Firm* — King & Partners, PLC

(57) ABSTRACT

A novel, flexible substrate assembly including a flexible substrate member having an inner surface and an outer surface, and a plurality of rigid or semi-rigid ribs associated with at least one of the inner and outer surfaces of the flexible substrate member. A chair assembly including a seat member, a back support member with an optional headrest, an optional left arm, an optional right arm, a floor-engaging base member which may form part of a frame assembly, a left side, a right side, a front side, and a back side, and a novel, flexible substrate assembly, wherein the novel flexible substrate assembly comprises a flexible substrate member having an inner surface and an outer surface, and a plurality of rigid or semi-rigid ribs associated with at least one of the inner and outer surfaces of the flexible substrate member.

12 Claims, 19 Drawing Sheets

(56) References Cited

U.S. PATENT DOCUMENTS 3,840,269 A * 10/1974 Ambrose ..... B29C 44/12 297/452.56 X
3,865,430 A 2/1975 Tanus
3,877,750 A * 4/1975 Scholpp ..... A47C 1/143 297/452.63 X
3,870,391 A 11/1975 Vernon
4,082,348 A 4/1978 Haury
4,798,414 A * 1/1989 Hughes ..... A47C 7/462 297/452.56 X
5,678,889 A 10/1997 Purcell, Jr.
5,957,536 A * 9/1999 Sullivan ..... A47C 5/12 297/452.63 X
5,975,641 A * 11/1999 Delesie ..... A47C 7/024 297/452.63 X
6,102,482 A * 8/2000 Dettoni ..... A47C 7/16 297/452.56 X
6,334,650 B1 * 1/2002 Chien-Chuan ..... A47C 7/024 297/452.63 X
6,371,556 B1 4/2002 Arai
6,540,292 B2 4/2003 Darling et al.
6,582,020 B1 6/2003 Tenenboym et al.
6,652,030 B2 11/2003 Conner et al.
6,921,135 B2 7/2005 Ellis et al.
7,222,920 B1 5/2007 Washington
7,320,503 B2 * 1/2008 Eysing ..... A47C 7/46 297/452.63 X
7,344,197 B2 * 3/2008 Sanderson ..... A47C 13/00 297/452.63
7,568,768 B1 * 8/2009 Tsai ..... A47C 7/28 297/452.56 X
7,585,027 B2 * 9/2009 Blendea ..... B60N 2/66 297/284.1
7,794,022 B2 * 9/2010 Caruso ..... A47C 1/03 297/452.56 X
8,075,061 B2 * 12/2011 Ko ..... A47C 7/40 297/452.56
8,157,329 B2 * 4/2012 Masoud ..... A47C 31/02 297/452.56 X
8,172,332 B2 * 5/2012 Masunaga ..... A47C 7/282 297/452.56 X
8,403,415 B2 3/2013 Lawson
8,991,931 B2 * 3/2015 Narita ..... A47C 7/30 297/452.56 X
8,998,339 B2 * 4/2015 Peterson ..... A47C 1/024 297/452.56 X
9,033,421 B2 * 5/2015 Wilkinson ..... A47C 1/03 297/452.56 X
2003/0168901 A1 * 9/2003 Wilkerson ..... A47C 1/023 297/452.56
2004/0000808 A1 * 1/2004 Maloney ..... A47C 7/028 297/452.63
2004/0245839 A1 * 12/2004 Bodnar ..... A47C 7/28 297/452.63
2006/0006715 A1 * 1/2006 Chadwick ..... A47C 1/03255 297/300.4
2006/0061195 A1 * 3/2006 Snyders ..... A47C 3/029 297/452.63
2008/0018147 A1 * 1/2008 Ybarrola ..... B29C 44/1204 297/214
2010/0127551 A1 * 5/2010 Heidmann ..... A47C 4/02 297/452.63 X
2010/0171346 A1 * 7/2010 Laframboise ..... B29C 44/12 297/183.1
2011/0006582 A1 * 1/2011 Carlson ..... A61G 5/1043 297/452.63 X
2011/0260509 A1 * 10/2011 Siu ..... A47C 7/021 297/180.14
2012/0025574 A1 * 2/2012 Wilkinson ..... A47C 1/03 297/300.1
2014/0077542 A1 * 3/2014 Vander Veen ..... A47C 1/032 297/228.11

* cited by examiner

FLEXIBLE SUBSTRATE ASSEMBLY AND ASSOCIATED FURNITURE USING THE SAME

CROSS-REFERENCE TO RELATED APPLICATIONS

This application claims the benefit of U.S. Provisional Application Ser. No. 61/990,133, filed May 8, 2014, entitled "Flexible Substrate Assembly And Associated Furniture Using The Same," which is hereby incorporated herein by reference in its entirety—including all references and appendices cited therein.

BACKGROUND OF THE INVENTION

1. Field of the Invention

The present invention relates in general to flexible substrate assemblies and, more particularly, to articles of furniture utilizing such flexible substrates, including, but not limited to, office, residential, theater, and cinema furniture (e.g., chairs, benches, loungers, couches, roll-top desks, tambour type enclosures, etcetera), as well as, automotive, aerospace, and mass transit seating that are configured to provide a patron or occupant with a flexible and adjustable experience not seen heretofore. The present invention further relates to methods of manufacturing flexible substrate assemblies for the above-identified applications.

2. Background Art

Adjustable articles of furniture have been known in the art for years and are the subject of a plurality of patents and/or publications, including: U.S. Pat. No. 8,403,415 entitled "Aircraft Passenger Seat Recline Mechanism," U.S. Pat. No. 7,222,920 entitled "Adjustable Chair," U.S. Pat. No. 6,921,135 entitled "Child's Adjustable Chair," U.S. Pat. No. 6,652,030 entitled "Chair Seat," U.S. Pat. No. 6,582,020 entitled "Theater Seat Assembly," U.S. Pat. No. 6,540,292 entitled "Adjustable Rocker Seat," U.S. Pat. No. 6,371,556 entitled "Seat Structure for Vehicle," U.S. Pat. No. 5,678,889 entitled "Moveable Theater Seats," U.S. Pat. No. 4,082,348 entitled "Adjustable Wheel Chair," U.S. Pat. No. 3,865,430 entitled "Theater Chair Automatically Movable By Remote Control," U.S. Pat. No. 3,297,359 entitled "Theatre Seat With Folding Arm Tablet," U.S. Pat. No. 2,828,803 entitled "Theater Chair With Self-Folding Seat," U.S. Pat. No. 2,492,119 entitled "Retracting Type Theater Chair," and U.S. Pat. No. 2,257,496 entitled "Chair For Motion Picture Theaters,"—all of which are hereby incorporated herein by reference in their entirety including all references cited therein.

U.S. Pat. No. 8,403,415 appears to disclose an adjustable passenger seat having a seat recline mechanism which includes a seat base having first and second non-intersecting seat path guide slots for guiding the travel of a translation guide assembly interconnected to a linear translating seat pan drive rail through the seat pan such that translational movement of the drive rail with respect to the seat base causes movement of the seat pan and the seat back between upright and flat seating positions.

U.S. Pat. No. 7,222,920 appears to disclose a chair that includes back and seat portions that include a padded member. Back support rails have opposed ends and include braces connected thereto. One end of the back support rails has notches that define flange portions. The braces traverse a rear surface of the back portion so that opposed ends thereof are conjoined to corresponding ones of the rail ends. A seat support member has a bottom surface and sidewalls extending upward therefrom that have notches formed along a top surface thereof. The seat support member includes inner lip portions. The flange portions are engageable with the inner lip portions, maintaining the back portion at a stable position. A shaft is conjoined to the seat support portion, legs are conjoined to the shaft, and casters are connected to the legs. A mechanism is included for adjusting the back portion forwardly above the seat support member.

U.S. Pat. No. 6,921,135 appears to disclose a child's chair that may be readily adjusted with regard to the height of the seat bottom, and the position of the seat back relative to the seat bottom. The use of telescoping legs and a slidable support for the seat back allow the chair to be adjusted for positioning according to the needs of a particular child.

U.S. Pat. No. 6,652,030 appears to disclose a chair seat that is movable between an upright and a forward position that includes a spring mechanism which biases the seat toward the upright position. The spring mechanism includes cam structures that utilize both compressional and torsional forces from the spring to bias the seat toward the upright position. The compression of the spring exerts a positive force that must be overcome before the seat can be moved out of its upright position. The chair seat is constructed from a number of discrete components that are secured together without the use of welding or separate fasteners, such as via snap-fits. The discrete components include positioning tabs, special shapes, and other features that prevent them from being improperly assembled. The components of the chair seat may all be constructed out of suitable durable plastics, such as polypropylene, polyethylene, polycarbonate, and glass filled thermoplastics.

U.S. Pat. No. 6,582,020 appears to disclose a theater seat assembly that includes a pair of opposed stanchions for attachment to a support surface, a generally horizontal seat portion disposed between and operatively connected to the stanchions, and a generally upright back portion disposed between and operatively connected to the stanchions. The theater seat assembly includes a counter-balanced pivot mechanism operatively connected to the seat portion and the stanchions to allow the seat portion to pivot freely relative to the stanchions when unoccupied relative to the stanchion. The theater seat assembly also includes a molded cover attached to at least one of the seat frame and the back frame and is injection molded from a fiberglass-reinforced copolymer.

U.S. Pat. No. 6,540,292 appears to disclose an adjustable children's rocking chair that can be readily converted without the use of tools between a configuration where it is used to support an infant in a more reclined position, and a configuration where it is suitable for use as a rocking chair by a toddler. The rocking chair includes a seat portion, a support portion connected to the seat portion, and the support portion being pivotably connected to a rocker base and being adjustable in length. The support portion includes a front frame assembly, such as a pair of front legs, and a rear frame assembly, such as a pair of rear legs, with each of the front legs being pivotably connected to a respective rear leg through a detachable joint. The seat portion includes a back support portion that is formed by a U-shaped seat back tube slipped inside a pocket in soft goods. Both ends of the U-shaped seat back tube are connected to the detachable joints pivotably connecting the rear legs to the front legs. The seat portion also includes a bottom formed by a rigid board permanently attached to a transverse member extending between the front legs and slipped into a second pocket in the soft goods. As the rear legs are telescopically changed in length, the legs pivot relative to each other and to the rocker base, with a resulting change in inclination of the seat back tube and back support portion.

U.S. Pat. No. 6,371,556 appears to disclose a seat cushion that pivots to be in a horizontal reversed state and it has a backside. A seat back is to pivot to be in a horizontal reversed state and has a reverse side. The reverse side in the horizontal reversed state has a height substantially equal to one of the backside of the seat cushion in the horizontal reversed state. An arm is attached to a lower end of the seat back and supports the lower end of the seat back to be rotated. A roller is fixed to a lower end of the arm and projects outward in a transverse direction of a vehicle body. A slide rail is fixed to a floor and engages with the roller to be slid forward and rearward. A lock mechanism detachably engages with the roller. A back link is connected to an intermediate fulcrum of the seat back above the roller and is connected to one of an intermediate portion of the slide rail and a peripheral member around the portion. A stopper is provided at the lower end of the seat back. The stopper engages with the arm for preventing the arm from rotating. An operating means is for releasing engagement with the stopper and the arm and is provided at an upper part of the seat back. The seat back pivots forward to be in a horizontal reversed state when releasing the lock mechanism and sliding the roller of the seatback rearward. The seat back pivots on the lower end thereof to fall down rearward for a reclining state when releasing engagement with the stopper and the arm.

U.S. Pat. No. 5,678,889 appears to disclose a modular assembly of theater seats aligned in a row. Each of the seats in the row moves with an identical motion in response to a coordinated sequence to create seat motions which can complement a scene being portrayed on a movie screen. Three or more rotatable shafts run along the row under the seats. The shafts are caused to rotate by hydraulic cylinders coupled to the shafts through bell cranks. Each seat is supported by three legs which are also coupled to the shafts by bell cranks. Rotation of the shafts causes vertical motion of the legs, and by coordinating the motions of the individual legs, in one embodiment of the invention, the seats can be made to move with linear vertical motion, or to rotate either side to side or fore and aft in the vertical plane. Linear fore and aft motion of the seats may be provided by a fourth rotatable shaft running along the row under the seats.

U.S. Pat. No. 4,082,348 appears to disclose an adjustable wheel chair which facilitates independent seat height and width adjustments to accommodate varying wheel chair size needs. The wheel chair includes a pair of side frame assemblies transversely movable relative to each other between a first closed position with the side frame assembly closely spaced to each other and a second opened position with the side frame assembly spaced apart from each other. The side frame assemblies each include upper and lower frame members and means for selectively adjusting the distance between these members to vary the height of a seat disposed adjacent the upper frame members. First and second cross brace assemblies are pivotally connected to each other generally at their midpoints and mounted transversely between the side frame assemblies in a manner so as to form a collapsible X-like configuration. Each cross brace assembly includes means for selectively adjusting the length thereof to thereby permit adjustment of the distance between the side frame assemblies when they are in the second position to thereby vary the width of the seat and seat back areas. Each cross brace assembly includes a seat bar member at the uppermost end thereof and to which a flexible seat is mounted. The seat bar members are disposed immediately adjacent an associated one of the upper frame members when the side frame assemblies are in the second position and are spaced vertically above the associated upper frame member when the side frame assemblies are moved to the first position. Guide means are employed to guide the seat bar members as the side frame assemblies are moved between the first and second positions. The seat and a flexible seat back include means for releasably accommodating flexible spacer members when the seat and seat back areas are widened by adjusting the lengths of the cross brace assemblies. An adjustable headrest structure may also be included for the comfort of the wheel chair user.

U.S. Pat. No. 3,865,430 appears to disclose a theater chair movable by remote control that comprises a support structure, a chassis having a back and arms installed on same, and a seat rotatably engaged to the chassis. The support structure comprises at each side of the chassis, a vertical sliding mechanism and a horizontal sliding mechanism. The sliding mechanisms comprise rotatable threaded spindles and sleeves threadedly engaged thereon. The horizontal sliding mechanisms are attached by universal joints to the chassis of the chair and both vertical and horizontal sliding mechanisms are driven by independent drive motors, operated by remote control by sending a signal in synchronism with a scene of the show. The seat contains a vibrator for producing vibrational and rhythmic movements in the seat.

U.S. Pat. No. 3,297,359 appears to disclose in combination with a seat supported between at least one pair of vertical members, a collapsible tablet assembly associated with an arm rest secured to one of said vertical members, said tablet assembly comprising a member pivotally secured to said arm rest so as to form in one position an extension of said arm rest, a shaft extending longitudinally of said pivotal member and configured for axial rotation thereon, a tablet secured to said shaft, and means on the inner end of said shaft cooperating with said arm rest for locking said pivotal member in said one position to prevent downward movement thereof when said tablet is in use.

U.S. Pat. No. 2,828,803 appears to disclose a seat mounting hinge whereby chair seats of the plywood type mounted on exposed hinges may be made self-folding to raised non-use positions, thus to provide maximum space between rows of seats for the ingress and egress of patrons. The seat mounting hinge in which the self-folding mechanism is enclosed so that it cannot injure the chair occupants or damage their wearing apparel. This patent further appears to disclose a self-folding mechanism which is adjustable so that the force with which the seat is automatically raised to non-use position can be adjusted, and in general to provide such a mechanism which is quiet in operation, efficient in use, and reasonably economical to manufacture.

U.S. Pat. No. 2,492,119 appears to disclose a theater chair of the retracting type wherein the chair occupant may move rearwardly in a sitting position in order to permit other theater patrons to pass in front of him/her.

U.S. Pat. No. 2,257,496 appears to disclose a chair for motion picture theaters and more particularly to a seat having an illuminated signal which is lit when the seat is unoccupied so as to facilitate the seating of patrons in the dark theater.

While the above-identified patents and/or publications do appear to disclose various configurations of adjustable furniture, their configurations remain non-desirous and/or problematic inasmuch as, among other things, none of the above-identified articles of furniture appear to be configured to provide a patron or occupant with a flexible and adjustable experience as provided herein. Furthermore, none of the above-identified articles of furniture appear to utilize flexible substrate assemblies that are adapted to cost effectively provide both adjustability and durability necessary in today's high volume residential, commercial, and industrial applications.

It is therefore an object of the present invention to provide cost-effective, durable, and flexible substrate assemblies for use in association with office, residential, theater, and cinema furniture, as well as, automotive, aerospace, and mass transit seating.

These and other objects of the present invention will become apparent in light of the present specification, claims, and appended drawings.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

SUMMARY OF THE INVENTION

Figure 1:
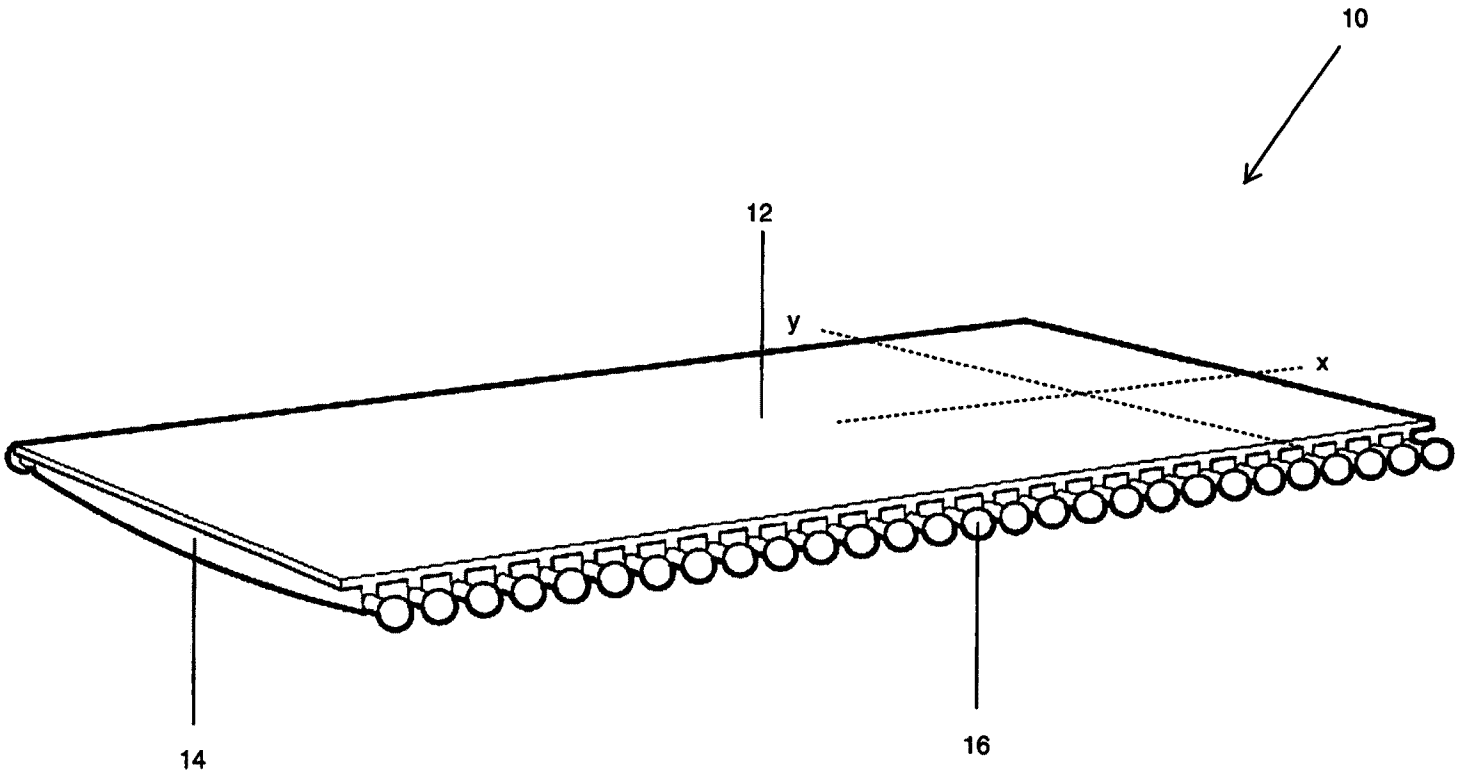
FIG. 1 of the drawings is an isometric view illustrating a flexible substrate assembly in a linear configuration in accordance with the present invention.
Figure 2A:
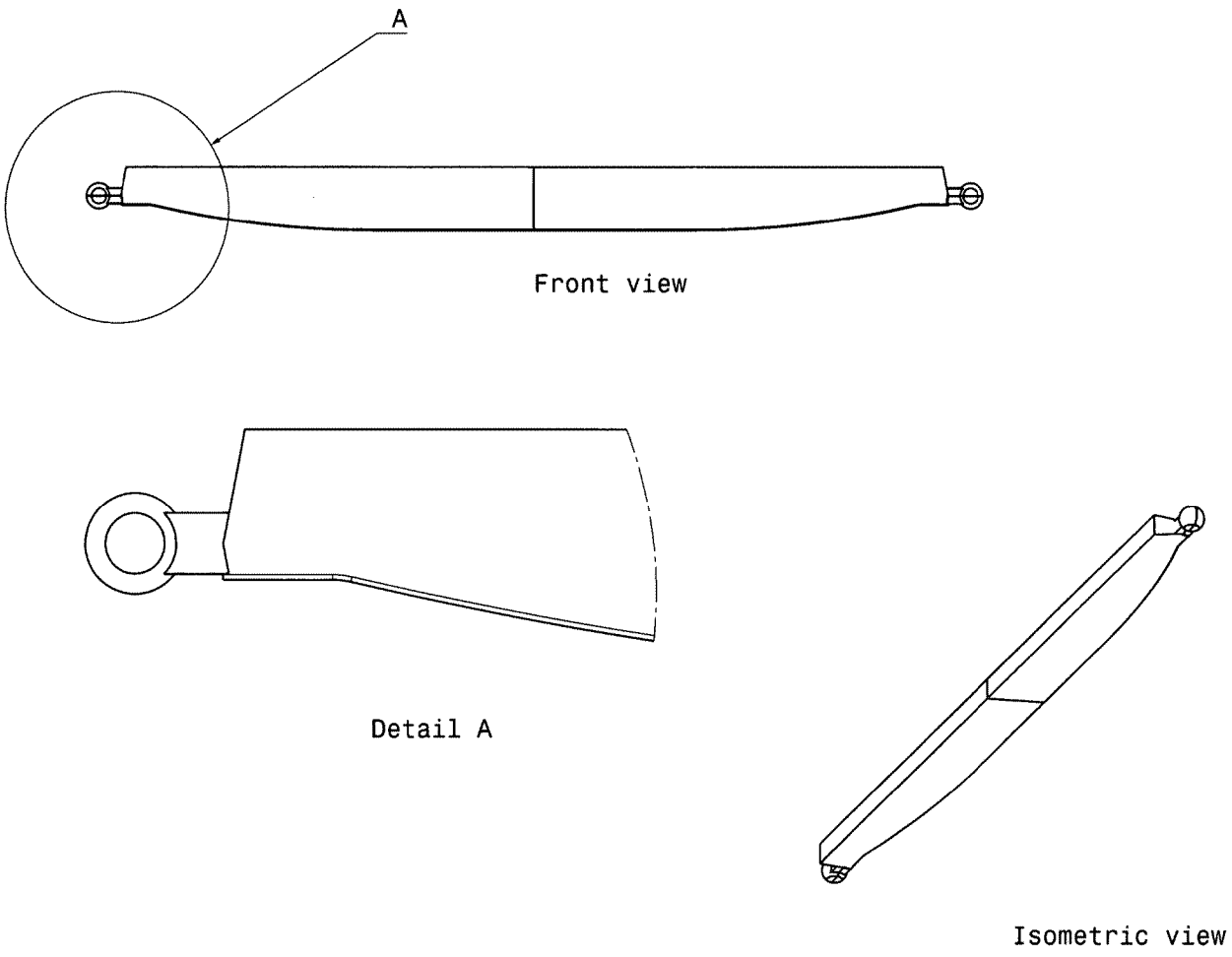
FIG. 2A of the drawings are isometric, front, and detail views illustrating a ball rib in accordance with the present invention.
Figure 2B:
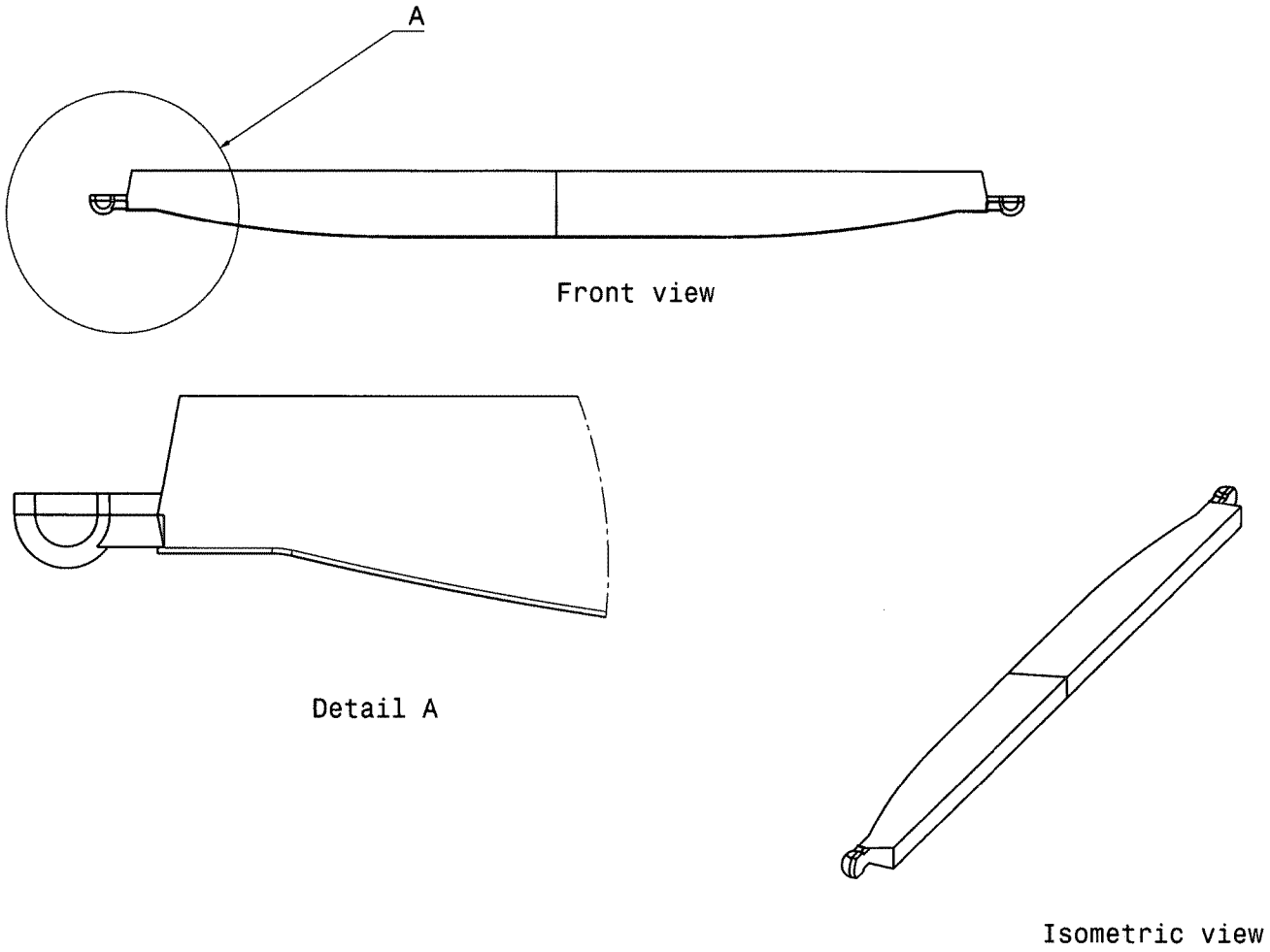
FIG. 2B of the drawings are isometric, front, and detail views illustrating a half-ball bottom rib in accordance with the present invention.
Figure 2C:
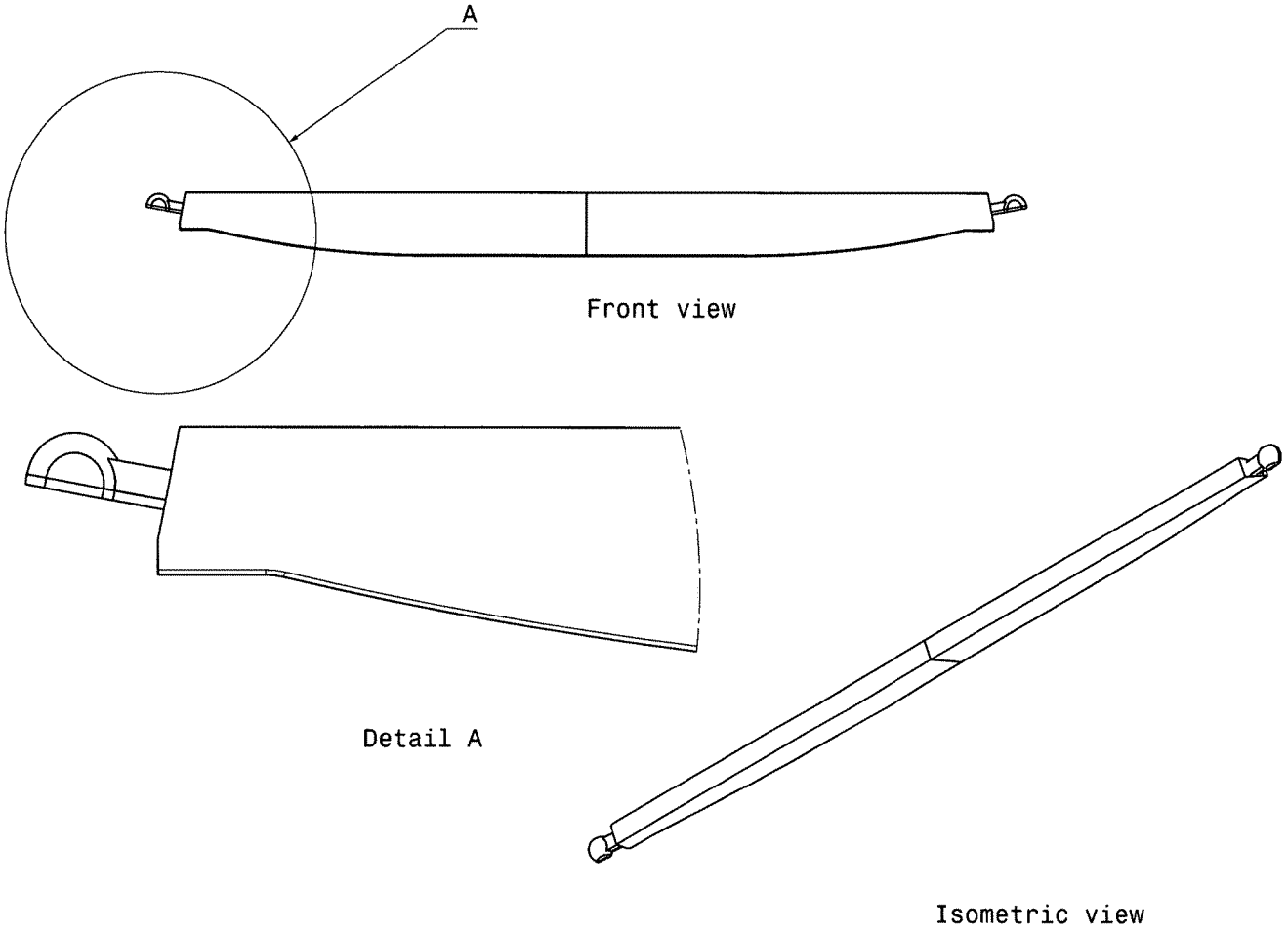
FIG. 2C of the drawings are isometric, front, and detail views illustrating a half-ball top rib in accordance with the present invention.
Figure 2D:
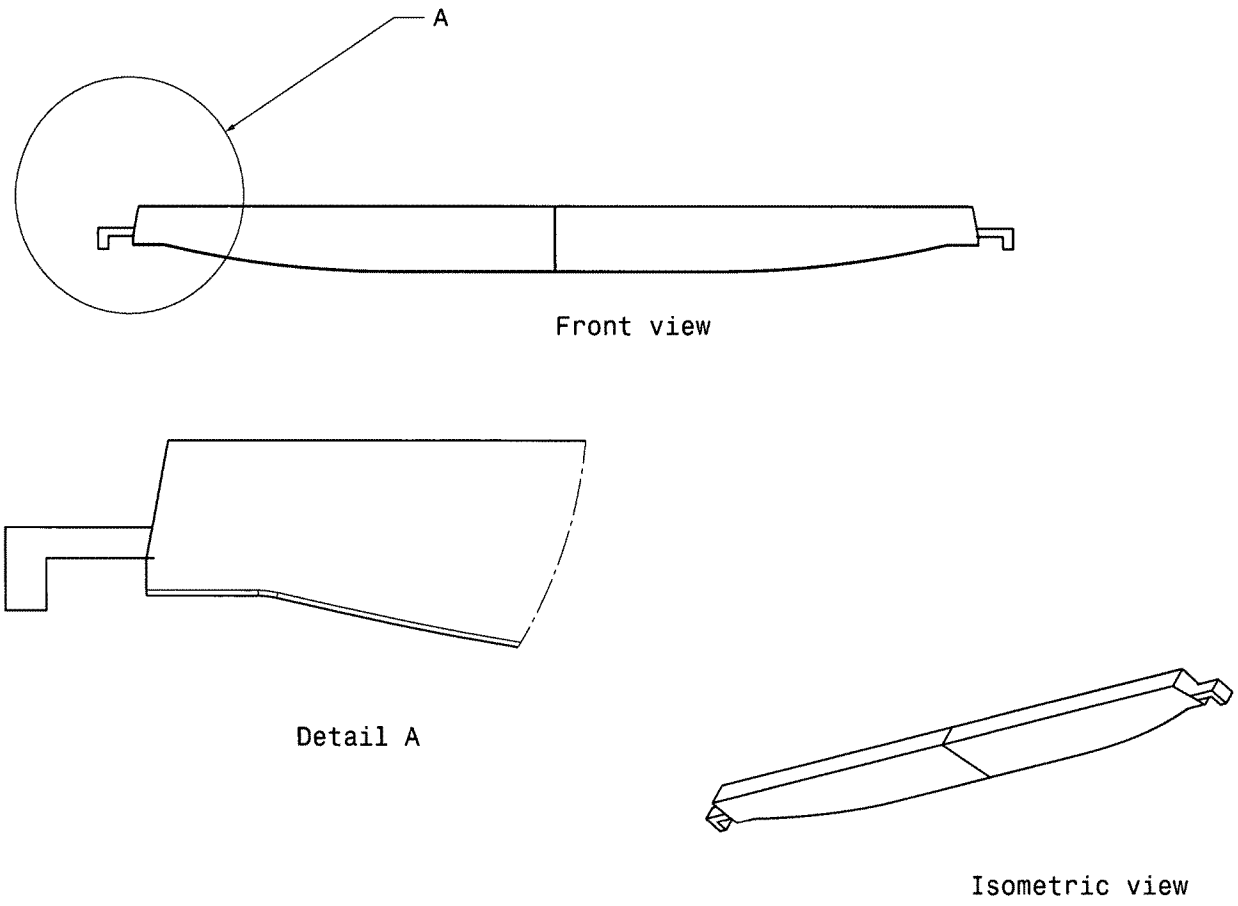
FIG. 2D of the drawings are isometric, front, and detail views illustrating a hook rib in accordance with the present invention.
Figure 2E:
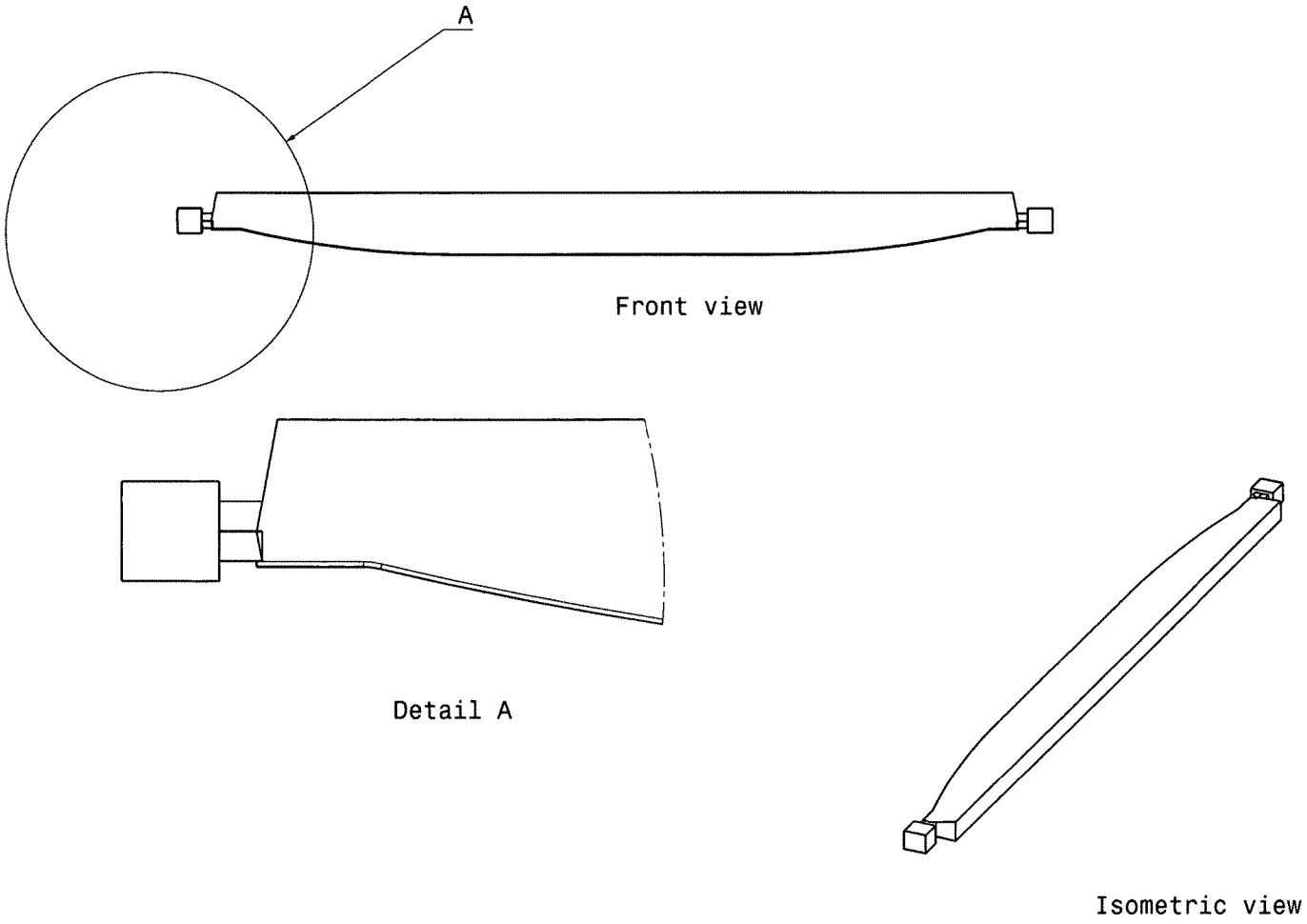
FIG. 2E of the drawings are isometric, front, and detail views illustrating a block rib in accordance with the present invention.
Figure 2F:
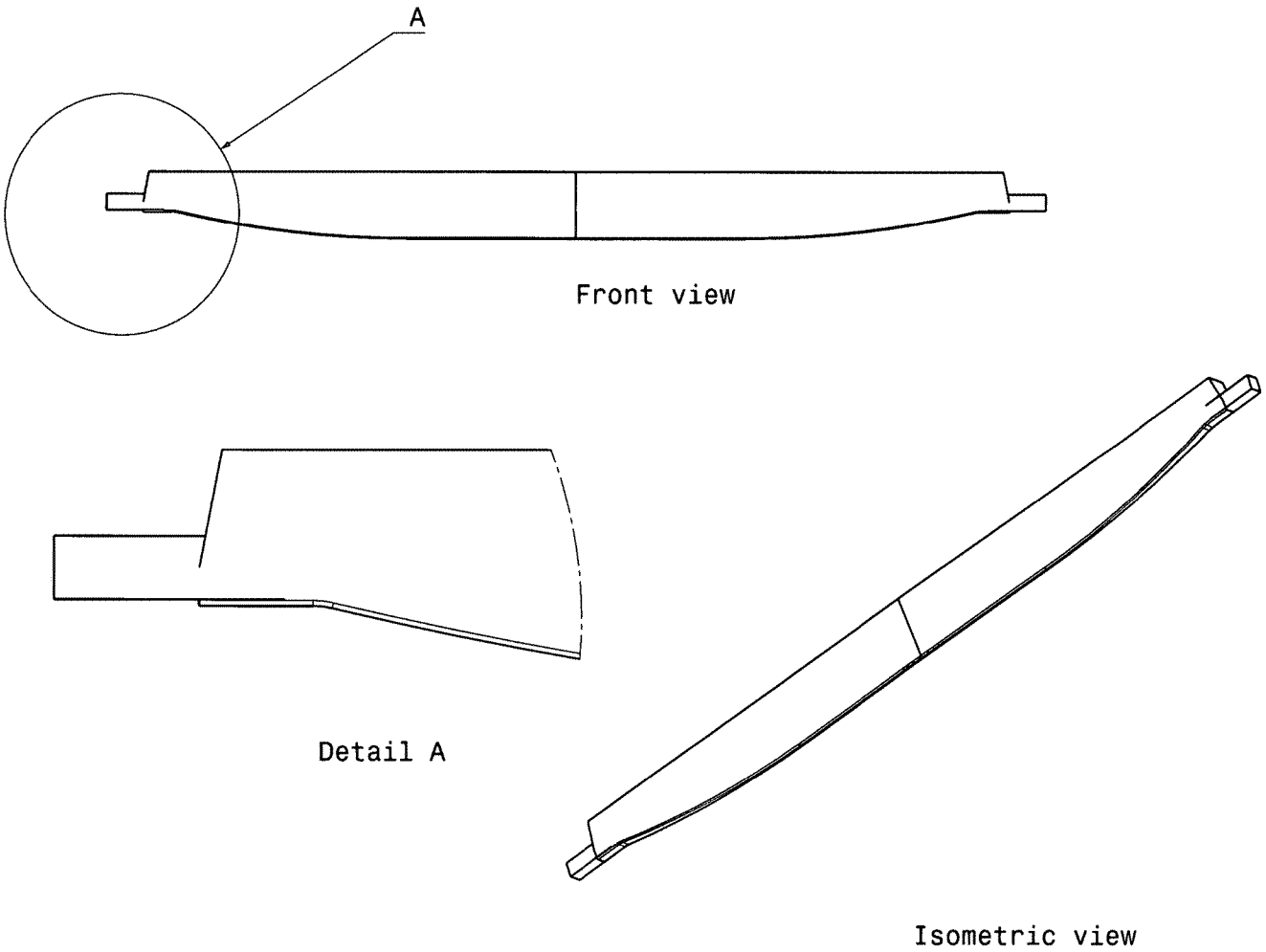
FIG. 2F of the drawings are isometric, front, and detail views illustrating a slide rib in accordance with the present invention.
Figure 2G:
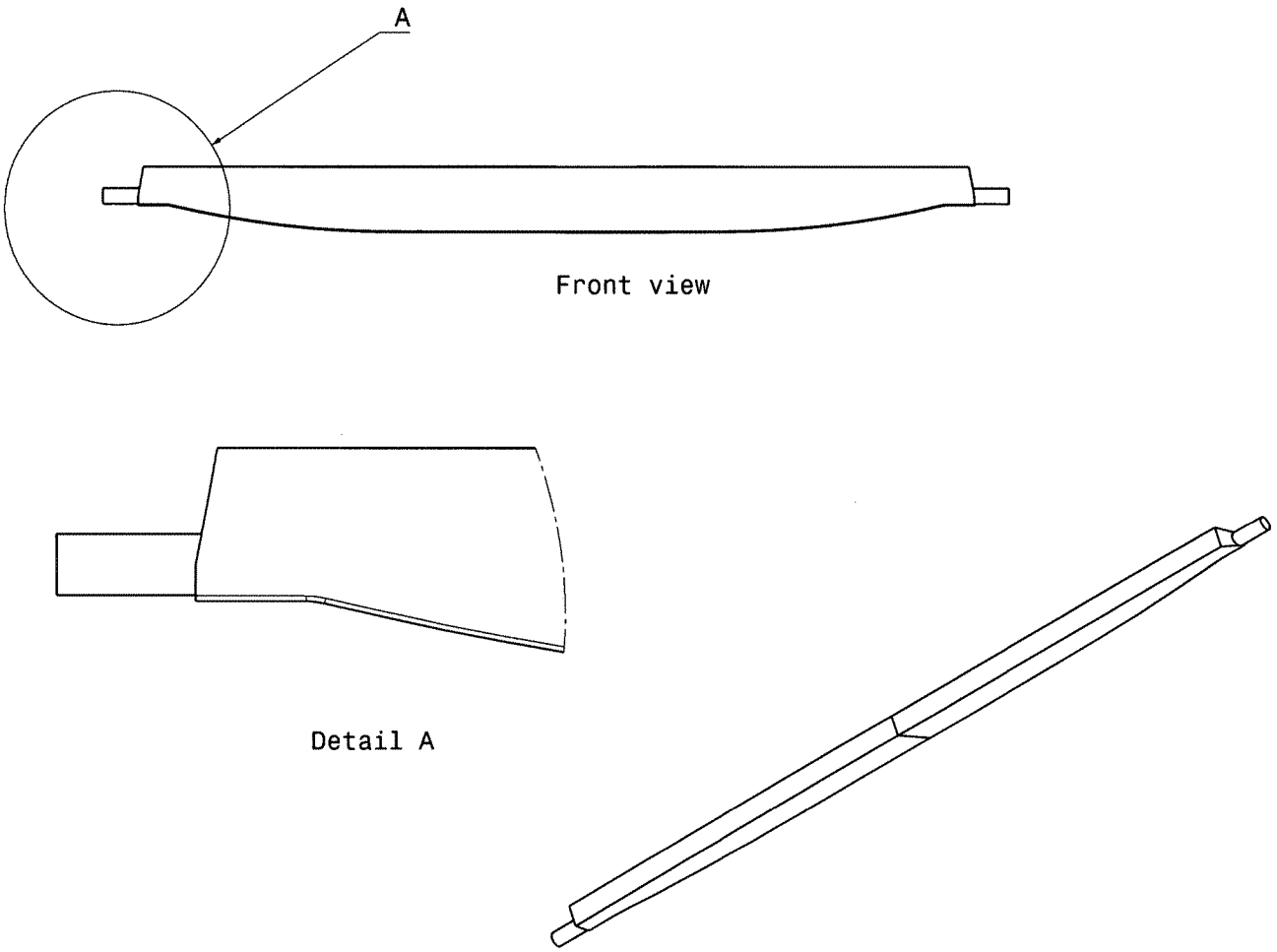
FIG. 2G of the drawings are isometric, front, and detail views illustrating a pin rib in accordance with the present invention.

The present invention is directed to, in one embodiment, a novel, flexible substrate assembly comprising: (a) a flexible substrate member having an inner surface and an outer surface; and (b) a plurality of rigid or semi-rigid ribs associated with at least one of the inner and outer surfaces of the flexible substrate member.

In a preferred embodiment of the present invention, the ribs comprise at least one of ball ribs, half-ball bottom ribs, half-ball top ribs, hook ribs, block ribs, slide ribs, pin ribs, and combinations thereof.

The present invention is further directed to, in one embodiment, a chair assembly comprising: (a) a seat member, a back support member with an optional headrest, an optional left arm, an optional right arm, a floor-engaging base member which may form part of a frame assembly, a left side, a right side, a front side, and a back side; and (b) a novel, flexible substrate assembly, wherein the novel flexible substrate assembly comprises: (1) a flexible substrate member having an inner surface and an outer surface; and (2) a plurality of rigid or semi-rigid ribs associated with at least one of the inner and outer surfaces of the flexible substrate member.

DETAILED DESCRIPTION OF THE INVENTION

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

The present invention generally relates to flexible substrate assemblies and, more particularly, to articles of furniture utilizing such flexible substrates, including, but not limited to, office, residential, theater, and cinema furniture, as well as, automotive, aerospace, and mass transit seating that are configured to provide a patron or occupant with a flexible and adjustable experience not seen heretofore.

Referring now to the drawings, and to FIG. 1 in particular, flexible substrate assembly 10 is shown in a linear configuration as generally comprising flexible substrate member 12 having an inner surface and an outer surface, and a plurality of rigid or semi-rigid ribs 14 associated with at least one of the inner and outer surfaces of the flexible substrate member. Rigid or semi-rigid ribs 14 preferably include cap members 16 which are used during production, as well as sometimes subsequently serve as tabs and/or guides in, for example, a channel of a chair, desk, drawer, and/or door.

Flexible substrate member 12 is preferably fabricated from, for example, an at least partially elastomeric and/or flexible material including natural and/or synthetic plastics and/or rubbers, saturated and/or unsaturated rubbers such as polyisoprene, butyl rubber, polyacrylic rubber, silicone, flurosilicone, flexible foams, I-skin type foams, self-skinning foams—just to name a few.

Rigid or semi-rigid ribs 14 are preferably fabricated from natural and/or synthetic plastic forming resins, rigid and/or semi-rigid plastics, metals (both ferrous and non-ferrous, alloys, natural materials (e.g., wood, bamboo, etcetera). As is best shown FIGS. 2A-2G ribs 14 may comprise, for example, ball ribs, half-ball bottom ribs, half-ball top ribs, hook ribs, block ribs, slide ribs, pin ribs, and combinations thereof.

Figure 3:
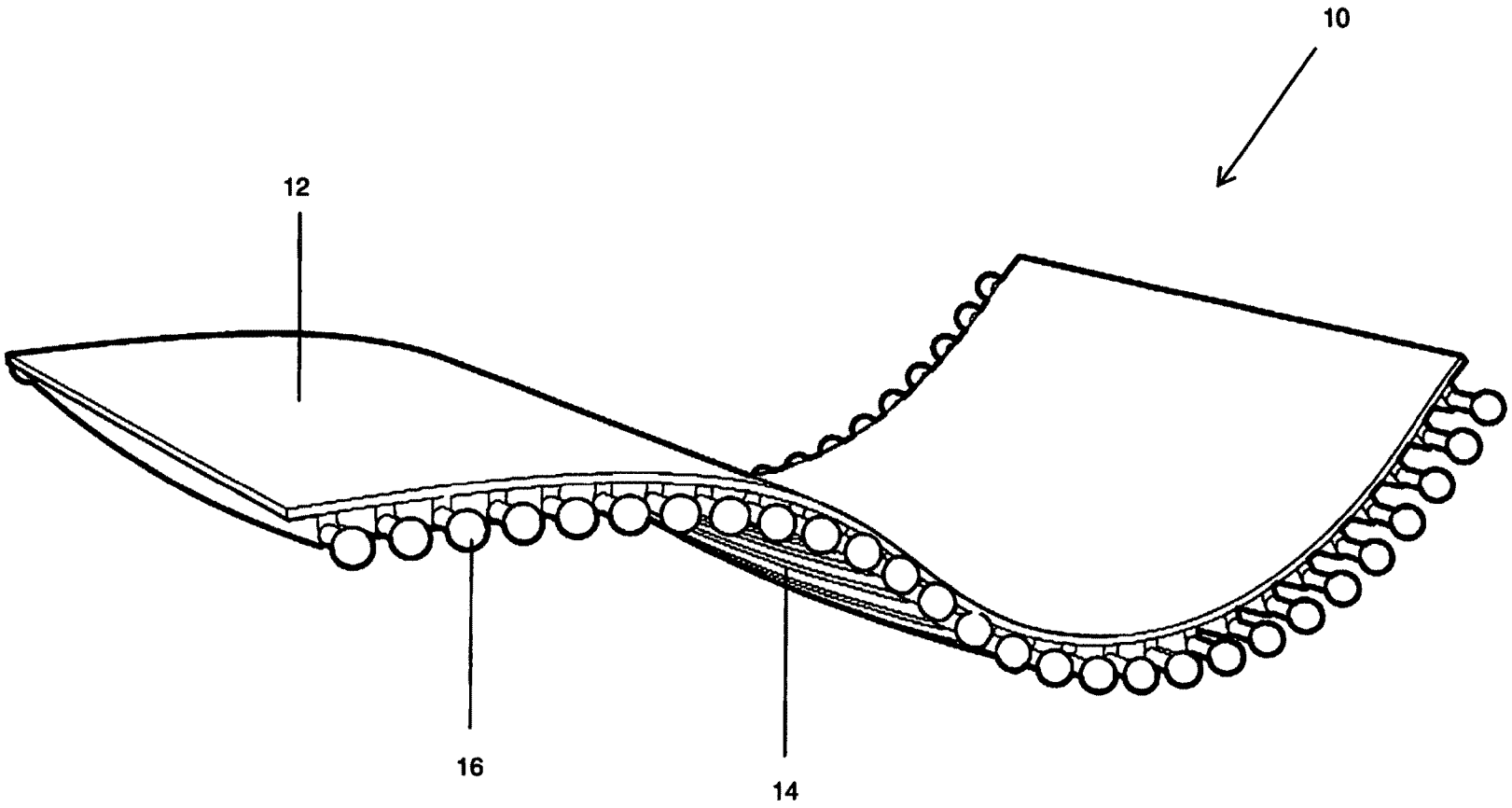
FIG. 3 of the drawings is an isometric view illustrating a flexible substrate assembly in a non-linear, articulated configuration in accordance with the present invention.

Referring now to FIG. 3 of the drawings, flexible substrate assembly 10 is shown in a non-linear, articulated configuration. It will be understood that flexible substrate assembly 10 is flexible and articulable along the X-axis, but generally not along the Y-axis (see FIG. 1) due to the structural configuration and association of rigid or semi-rigid ribs 14.

Figure 4:
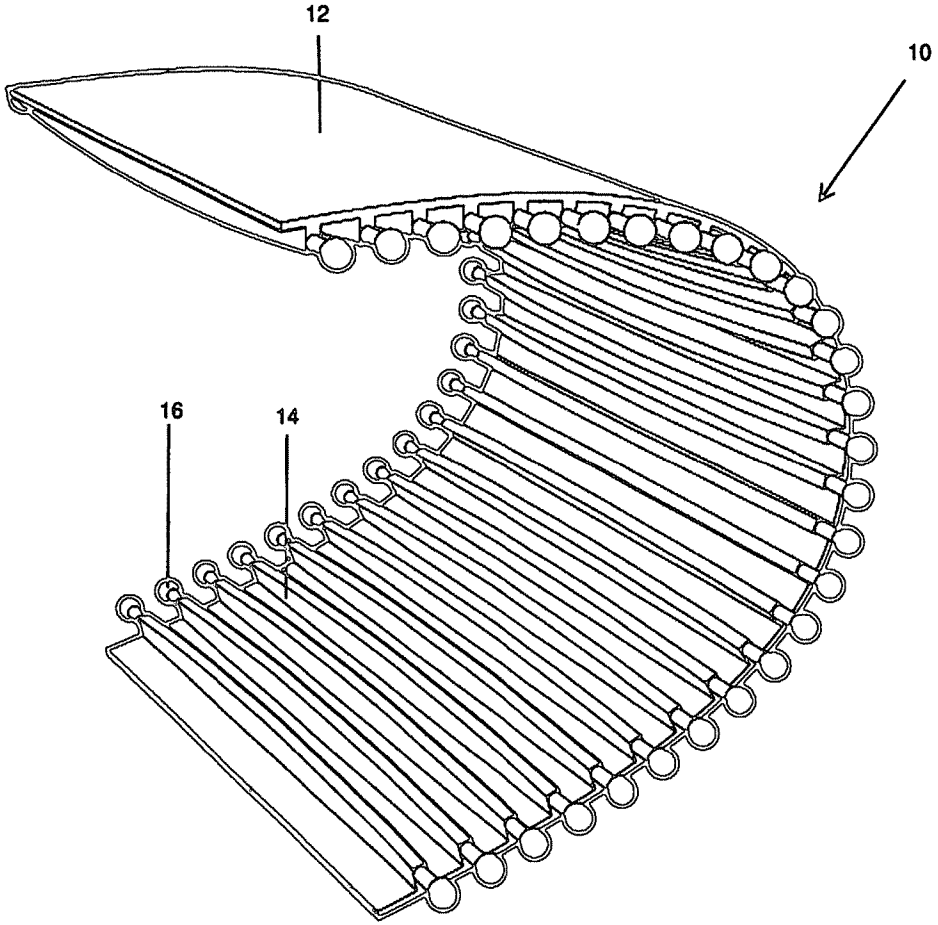
FIG. 4 of the drawings is an isometric view illustrating a flexible substrate assembly in a substantially U-shaped configuration in accordance with the present invention.

Referring now to FIG. 4 of the drawings, flexible substrate assembly 10 is shown in a substantially U-shaped configuration that is optimal for utilization in an article of furniture.

Figure 5:
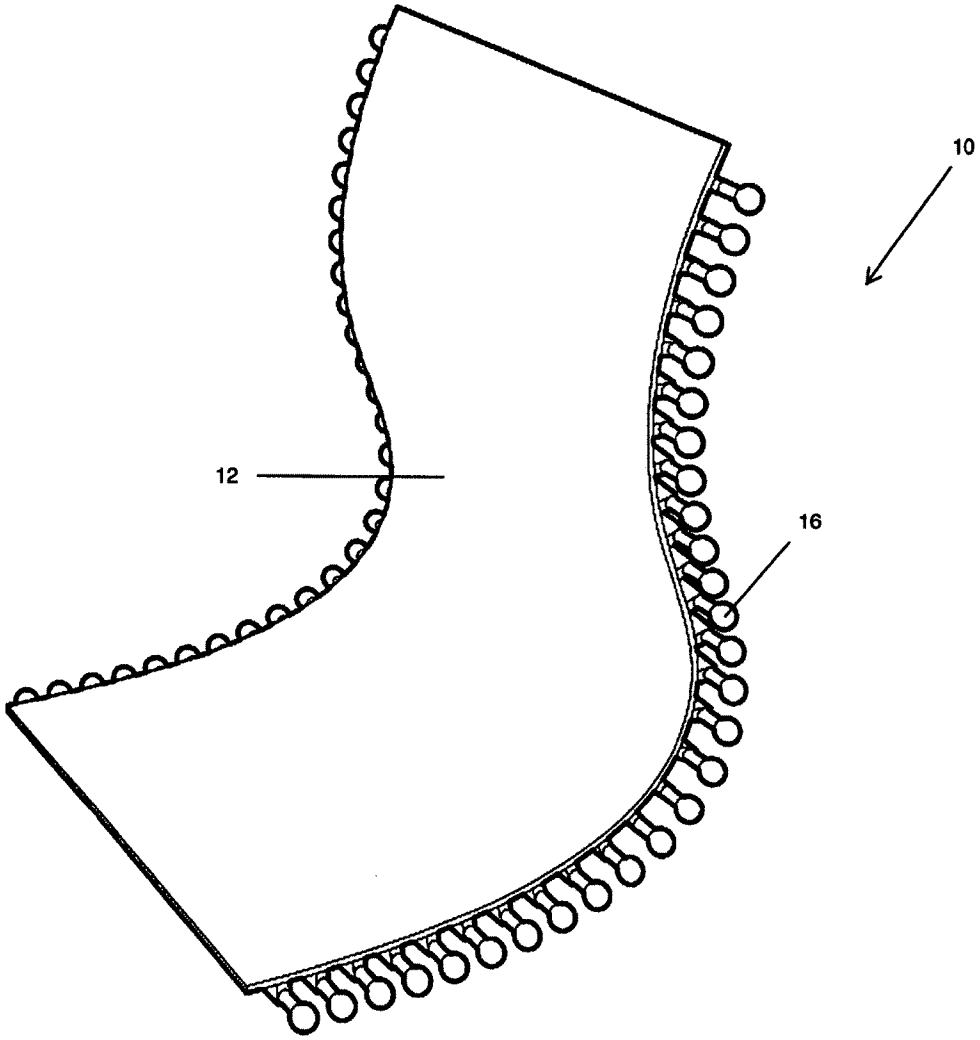
FIG. 5 of the drawings is an isometric view illustrating a flexible substrate assembly in a non-linear, articulated chair configuration in accordance with the present invention.

Referring now to FIG. 5 of the drawings, flexible substrate assembly 10 is shown in a configuration that is optimal for utilization as a chair having a base member and a backrest.

Figure 6:
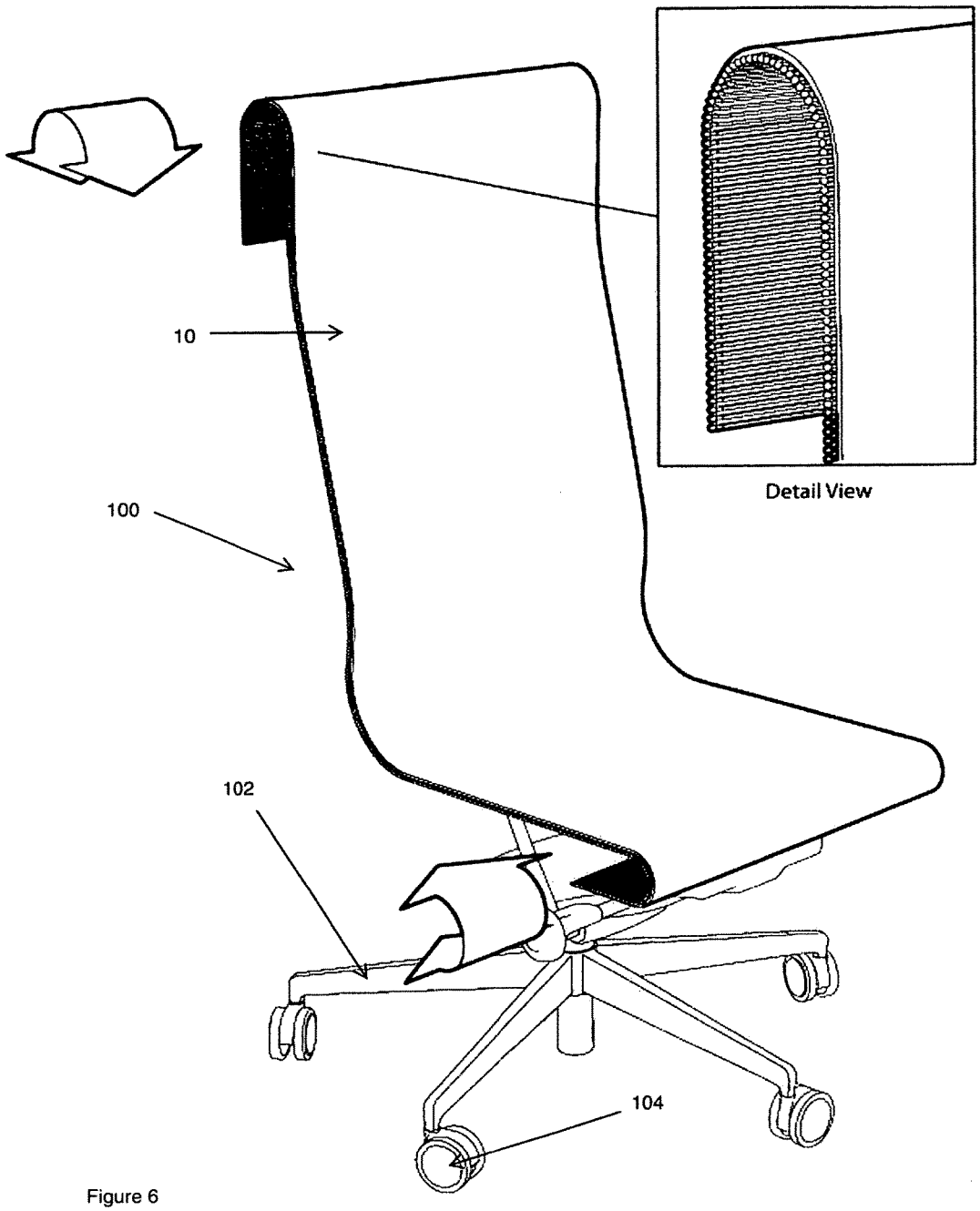
FIG. 6 of the drawings is an isometric view illustrating an office chair having a flexible substrate assembly in accordance with the present invention.
Figure 7:
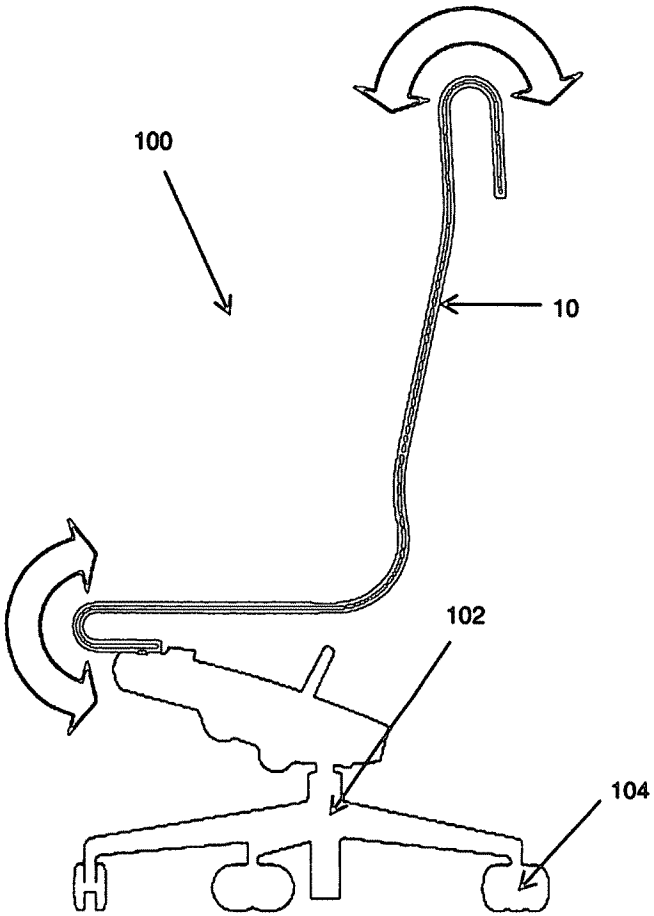
FIG. 7 of the drawings is a side elevation view illustrating an office chair having a flexible substrate assembly in a non-extended configuration in accordance with the present invention.
Figure 8:
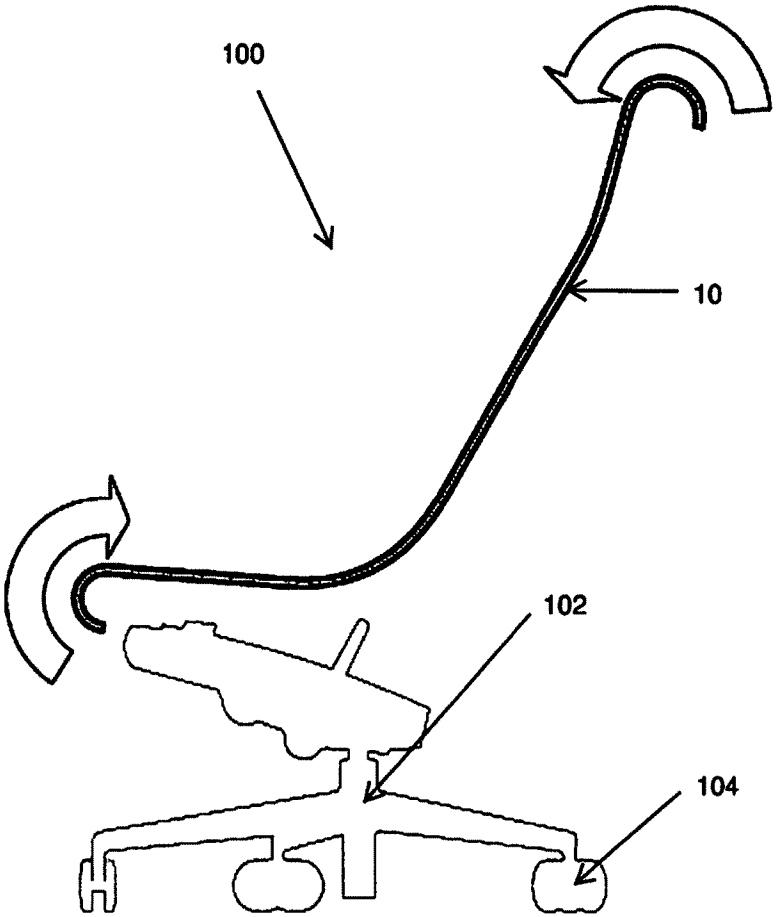
FIG. 8 of the drawings is a side elevation view illustrating an office chair having a flexible substrate assembly in an extended configuration in accordance with the present invention.

Referring now collectively to FIGS. 6-8 of the drawings, office chair 100 is shown as generally comprising flexible substrate assembly 10, frame assembly 102, and floor-engaging wheels or casters 104. Office chair 100 is adjustable from a non-extended configuration (see FIG. 7) to an extended configuration (see FIG. 8). It will be understood that the base member and backrest of office chair 100 are independently and essentially infinitely displaceable between their respective non-extended and extended configurations.

In one embodiment of the present invention the purpose of the frame or side rails is to provide structural support to the type tambour seating and/or hold the tambour in its final position. The rib ends can be designed to slide into the rails and/or snap in and/or on the rails/frame during assembly. The rails can act as a guide so the person assembling the chair simply pulls the tambour down the rails to form the seat. The rails or frame can be made out of any conventional structural material including plastics, metals, or other common materials used in seating construction. The rails may be part of the chair frame which reduces the amount of pieces in the chair.

Figure 9:
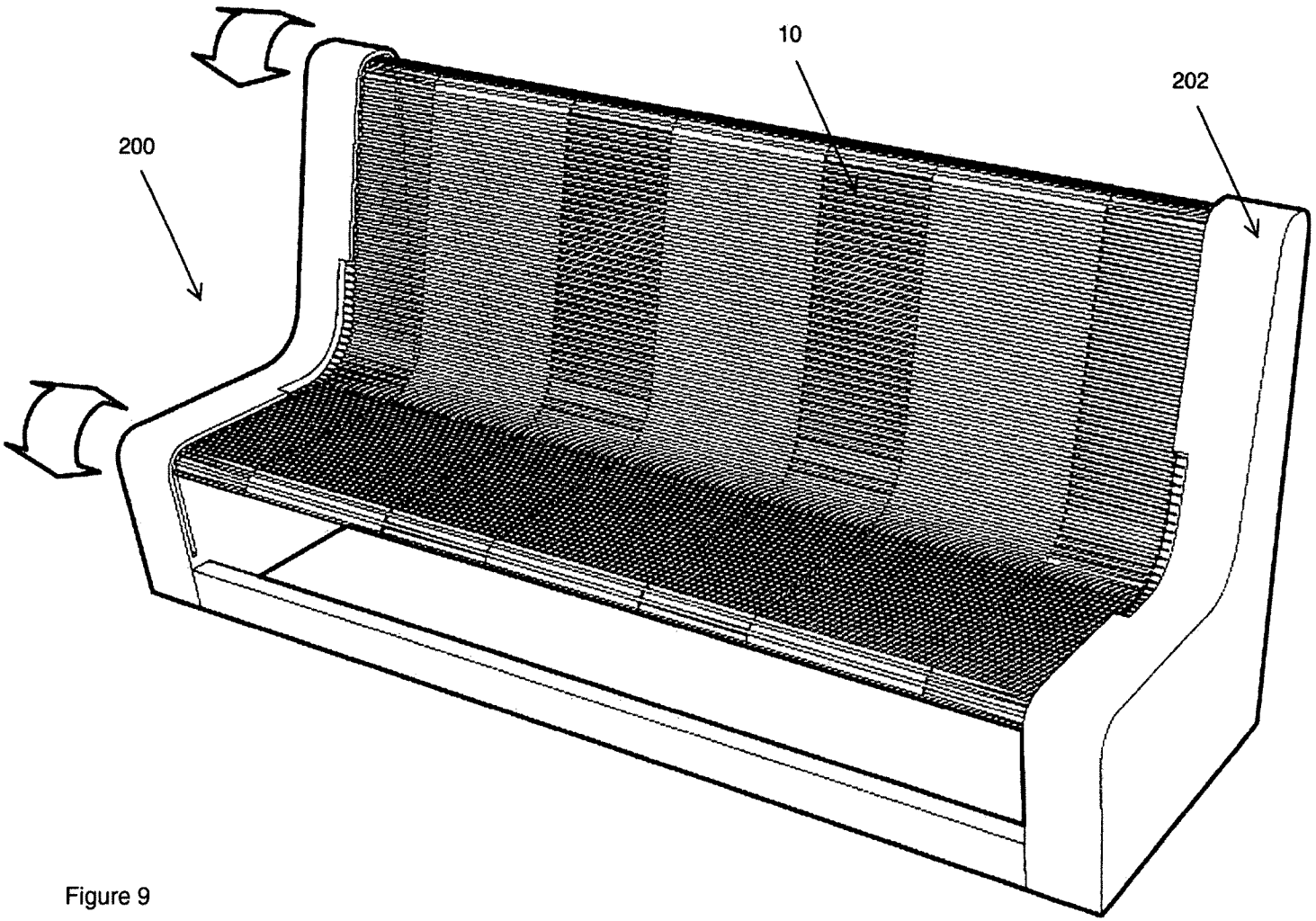
FIG. 9 of the drawings is an isometric view illustrating a public and/or mass transit bench having a flexible substrate assembly in accordance with the present invention.

Referring now to FIG. 9 of the drawings, public and/or mass transit bench 200 is shown as generally comprising frame member 202 having flexible substrate assembly 10. Notably, both the base member and the backrest of bench 200 are adjustable due to the flexibility of substrate assembly 10.

Figure 10:
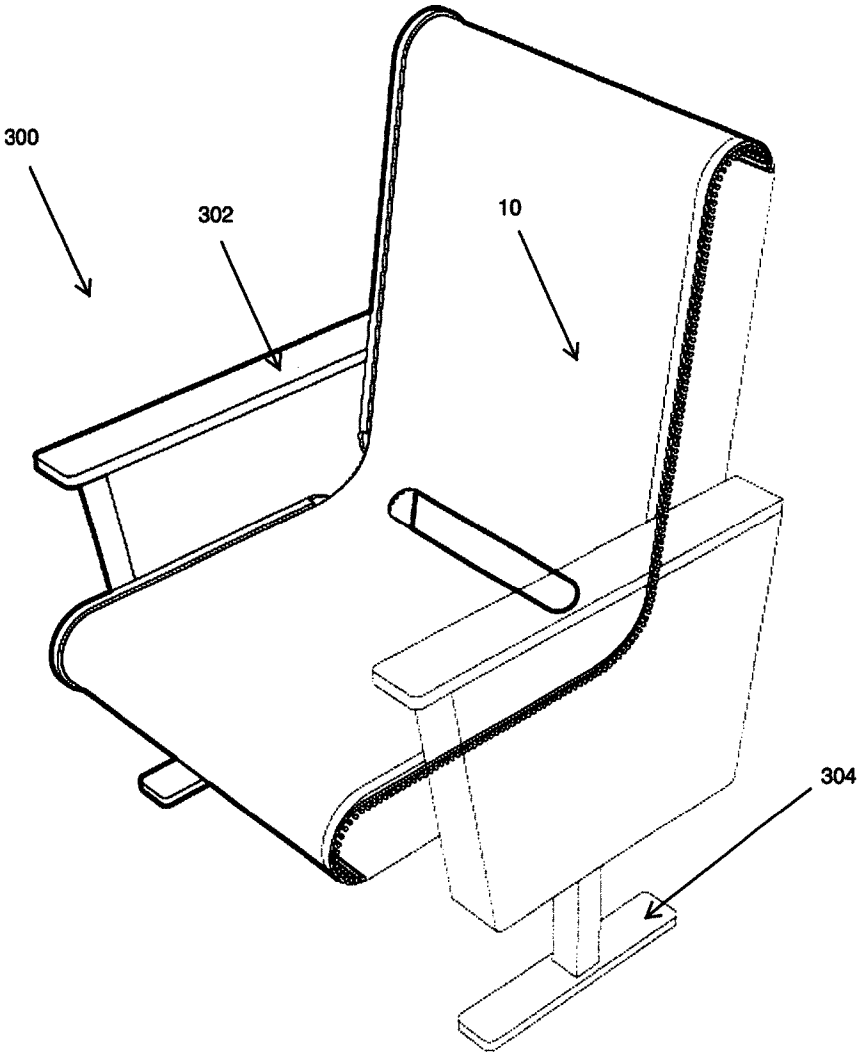
FIG. 10 of the drawings is an isometric view illustrating a theater lounger having a flexible substrate assembly with a seating member in a deployed configuration in accordance with the present invention.
Figure 11:
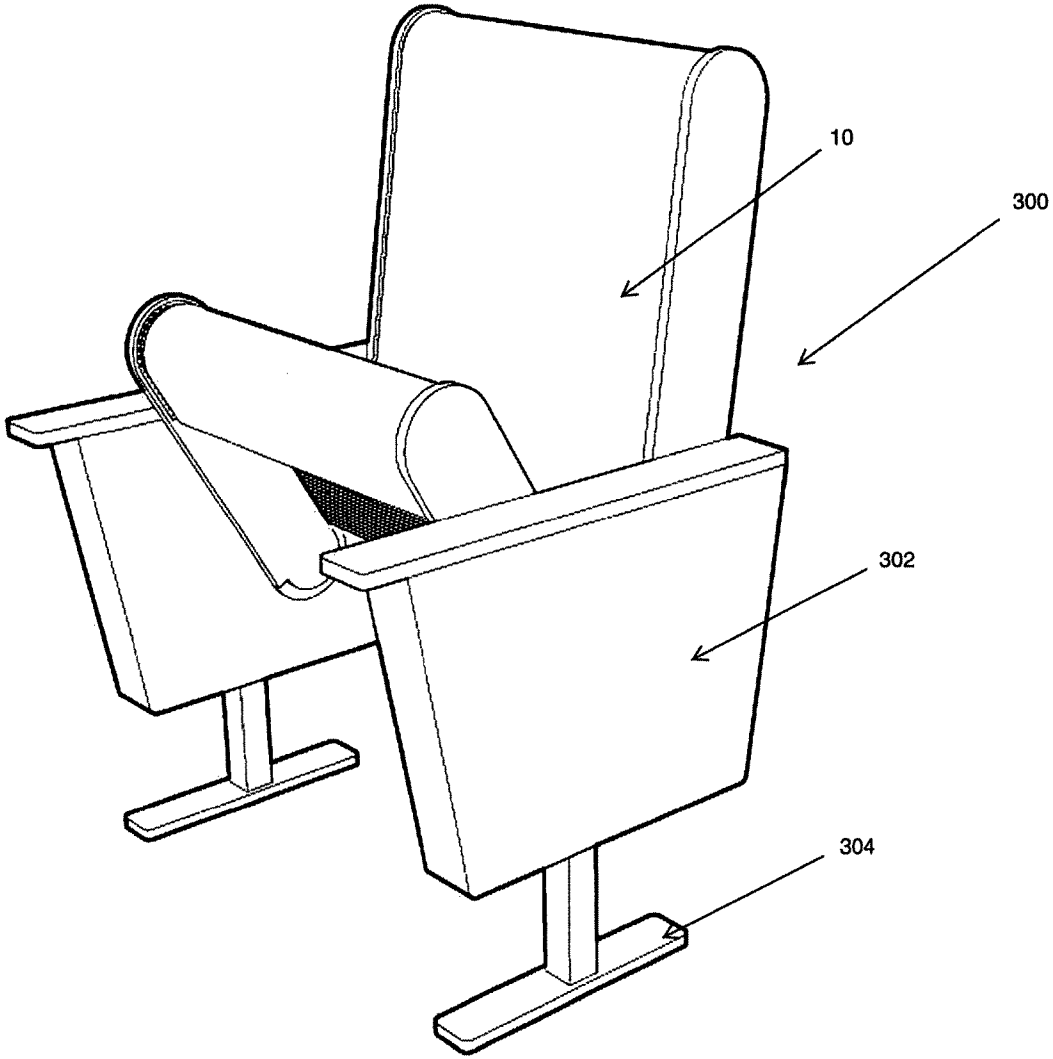
FIG. 11 of the drawings is an isometric view illustrating a theater lounger having a flexible substrate assembly with a seating member in a retracted configuration in accordance with the present invention.

Referring now collectively to FIGS. 10-11 of the drawings, theater lounger 300 is shown as generally comprising flexible substrate assembly 10, arm rests 302, and floor-engaging base member 304. Theater lounger 300 is displaceable between a retracted configuration (see FIG. 10) and a deployed configuration (see FIG. 11). Similarly to other embodiments of the present invention, theater lounger 300 includes a base member and a backrest that are adjustable due to flexible substrate assembly 10.

It will be understood that the designs of the present invention are similar in nature to a roll-top desk or a tambour door enclosure. Notably, these novel designs allow the seat to form to almost any contour and simplify manufacturing and assembly. The embodiments of the present invention also offer design flexibility while not sacrificing comfort. In particular, the reduction in parts during assembly reduces materials used, assembly time, weight and allows for potentially smaller shipping containers.

In accordance with the present invention, the seating concept utilizes a multiple "shot" molding process to accomplish the desired results. Specifically, the process consists of molding structural ribs on the backside of the part with a soft over-mold of one or more materials on the front. The ribs provide some structural support of the chair while supporting the person and the soft rubber(s) or foam(s) provide the desired comfort of the seat. The steps of the process are to mold the rib structure in a rigid or semi-rigid material of one or more materials and then molding the rubber(s) or foam(s) on the front surface. This design reduces the assembly time and materials used in conventional manufacturing methods.

The design of the present invention allows for the seat to flex as the person leans back in the chair. The chair can be a simple one-piece design or a multiple piece design similar to conventional office chairs. The front edge of the chair can be extended out on a simple track to provide additional leg support. A headrest can also be implemented using the same extension method. Additional support can be provided in a lumbar or other areas by simply stiffening the ribs in that area, adding more soft cushion, or other conventional methods such as air bag or mechanical leverage advantages.

In one aspect of the invention, the process can be used in many designs and several industries. Non-limiting examples include office chairs, task chairs, stools, stadium seating, benches, ottomans, foot rests, automotive seating, aircraft seating, outdoor seating, Adirondack chairs, residential seating, couches, theatre seating, etcetera. The materials used can provide as much comfort as most any other form of seating while significantly reducing materials used, weight, and time to manufacture and assemble. The parts are molded in a flat layout which also can reduce the size of the box used for shipping. Indeed, office chairs are typically known for shipping a lot of air because of the overall size vs. weight of the bulky product.

In accordance with the present invention, cushions can also be wrapped post process with fabrics, leather, vinyls or other materials suited for seating applications.

Figure 12:
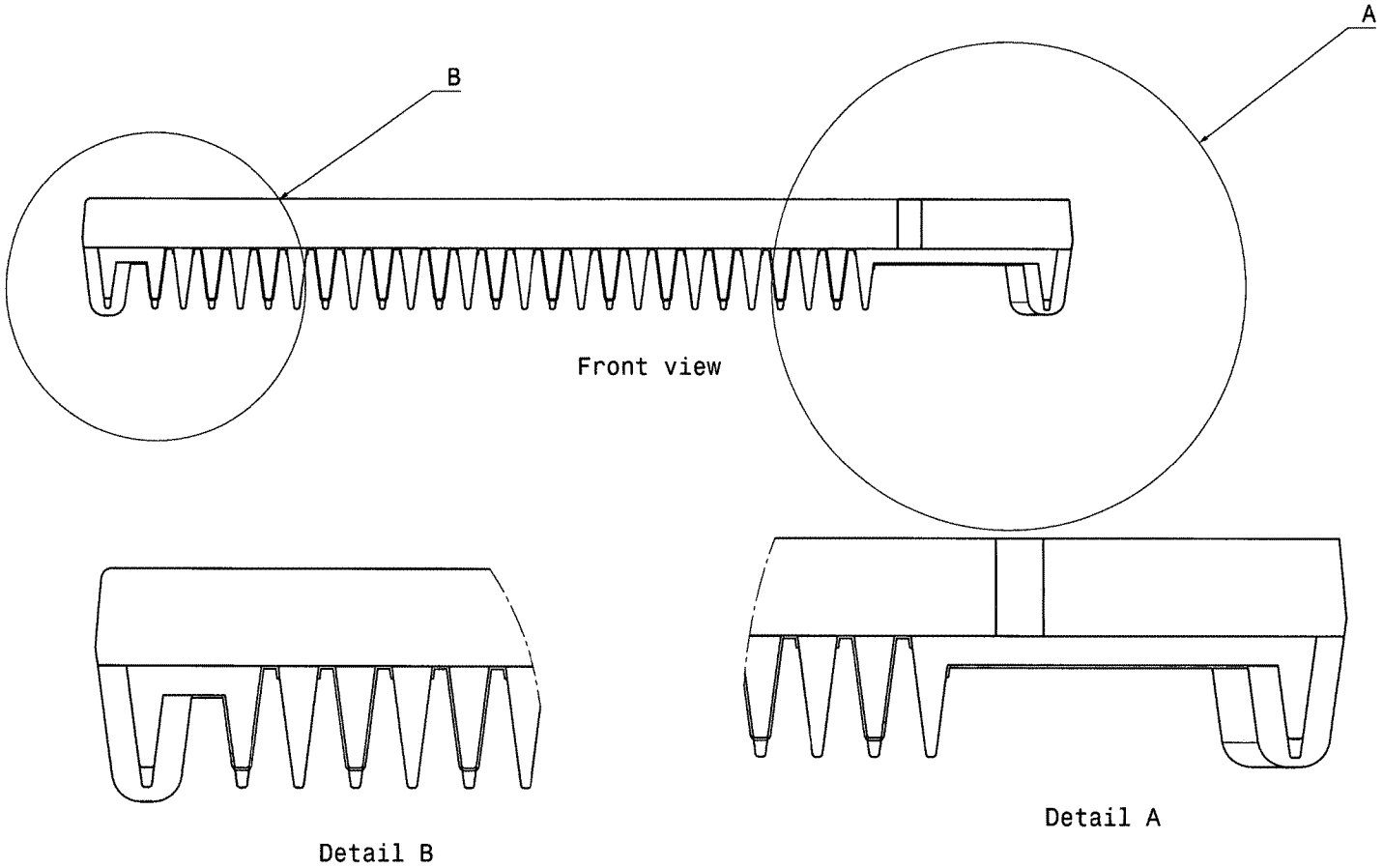
FIG. 12 of the drawings are front and detail views illustrating a flexible substrate assembly associated with a thick foam over-mold member in accordance with the present invention.
Figure 13:
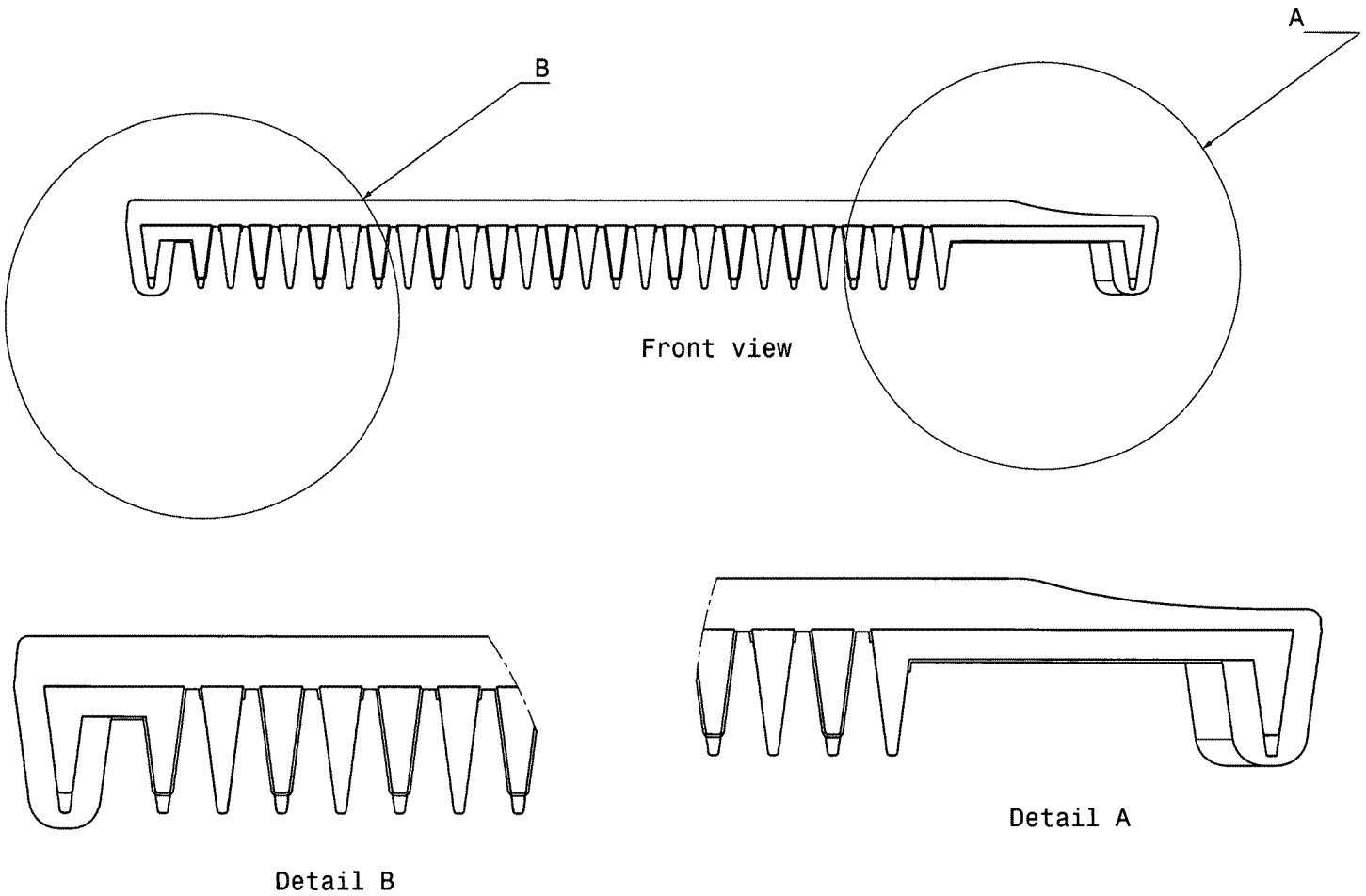
FIG. 13 of the drawings are front and detail views illustrating a flexible substrate assembly associated with a thin foam over-mold member in accordance with the present invention.

Referring now to FIGS. 12-13, thick and/or thin foam can be over-molded, integrated, associated, and/or form part of flexible substrate assembly 10.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A flexible substrate assembly, comprising:

a plurality of rigid or semi-rigid ribs, wherein each one of the plurality of rigid or semi-rigid ribs include a length, a left end and a right end;

a flexible substrate member having an inner surface and an outer surface, wherein the flexible substrate member is over-molded onto at least a portion of the plurality of rigid or semi-rigid ribs such that the left end and the right end of each one of the plurality of rigid or semi-rigid ribs are not over-molded with the flexible substrate member; and wherein the flexible substrate assembly is flexible and articulable along a first axis that is orthogonal to the length of each one of the plurality of rigid or semi-rigid ribs, but non-flexible and non-articulable along a second axis that is orthogonal to the first axis.

2. The flexible substrate assembly according to claim 1, wherein the ribs comprise ball ribs.

3. The flexible substrate assembly according to claim 1, wherein the ribs comprise half-ball bottom ribs.

4. The flexible substrate assembly according to claim 1, wherein the ribs comprise half-ball top ribs.

5. The flexible substrate assembly according to claim 1, wherein the ribs comprise hook ribs.

6. The flexible substrate assembly according to claim 1, wherein the ribs comprise block ribs.

7. The flexible substrate assembly according to claim 1, wherein the ribs comprise slide ribs.

8. The flexible substrate assembly according to claim 1, wherein the ribs comprise pin ribs.

9. The flexible substrate assembly according to claim 1, wherein the ribs comprise at least one of ball ribs, half-ball bottom ribs, half-ball top ribs, hook ribs, block ribs, slide ribs, pin ribs, and combinations thereof.

10. A chair assembly, comprising:

a seat member, a back support member with an optional headrest, an optional left arm, an optional right arm, a floor-engaging base member which may form part of a frame assembly, a left side, a right side, a front side, and a back side;

a flexible substrate assembly, wherein the flexible substrate assembly comprises a plurality of rigid or semi-rigid ribs, wherein each one of the plurality of rigid or semi-rigid ribs include a length, a left end and a right end, and a flexible substrate member having an inner surface and an outer surface, wherein the flexible substrate member is over-molded onto at least a portion of the plurality of rigid or semi-rigid ribs such that the left end and the right end of each one of the plurality of rigid or semi-rigid ribs are not over-molded with the flexible substrate member;

wherein the flexible substrate assembly is flexible and articulable along a first axis that is orthogonal to the length of each one of the plurality of rigid or semi-rigid ribs, but non-flexible and non-articulable along a second axis that is orthogonal to the first axis;

wherein the seat member and the back support member comprise the flexible substrate assembly;

wherein the flexible substrate assembly of the seat member is displaceable between a non-extended configuration and an extended configuration proximate a front end thereof; and wherein the flexible substrate assembly of the back support member is displaceable between a non-extended configuration and an extended configuration proximate an upper end thereof.

11. The chair assembly according to claim 10, wherein the ribs comprise at least one of ball ribs, half-ball bottom ribs, half-ball top ribs, hook ribs, block ribs, slide ribs, pin ribs, and combinations thereof.

12. A chair assembly, comprising:

a seat member, a back support member with an optional headrest, an optional left arm, an optional right arm, a floor-engaging base member which may form part of a frame assembly, a left side, a right side, a front side, and a back side;

a flexible substrate assembly, wherein the flexible substrate assembly comprises a plurality of rigid or semi-rigid ribs, wherein each one of the plurality of rigid or semi-rigid ribs include a length, a left end and a right end, and a flexible substrate member having an inner surface and an outer surface, wherein the flexible substrate member is over-molded onto at least a portion of the plurality of rigid or semi-rigid ribs such that the left end and the right end of each one of the plurality of rigid or semi-rigid ribs are not over-molded with the flexible substrate member, and wherein the left end and the right end of each one of the plurality of rigid or semi-rigid ribs are positioned within channels of guide plates;

wherein the flexible substrate assembly is flexible and articulable along a first axis that is orthogonal to the length of each one of the plurality of rigid or semi-rigid ribs, but non-flexible and non-articulable along a second axis that is orthogonal to the first axis;

wherein the seat member and the back support member comprise the flexible substrate assembly;

wherein the flexible substrate assembly of the seat member is displaceable between a non-extended configuration and an extended configuration proximate a front end thereof; and wherein the flexible substrate assembly of the back support member is displaceable between a non-extended configuration and an extended configuration proximate an upper end thereof.

* * * * *